United States Patent [19]

Stanford

[11] 4,134,002

[45] Jan. 9, 1979

[54] DOWN SPOUTS PROVIDED WITH HEATING ELEMENTS

[76] Inventor: George H. Stanford, 191 Spurwink Rd., Scarborough, Me. 04074

[21] Appl. No.: 817,606

[22] Filed: Jul. 21, 1977

Related U.S. Application Data

[60] Continuation of Ser. No. 634,043, Nov. 21, 1975, abandoned, which is a continuation of Ser. No. 469,121, May 13, 1974, abandoned, which is a division of Ser. No. 293,297, Sep. 28, 1972, Pat. No. 3,821,512.

[51] Int. Cl.[2] ..... H05B 1/00

[52] U.S. Cl. ..... 219/213; 138/33; 219/301; 219/535; 219/536; 338/252; 338/311

[58] Field of Search ..... 219/201, 213, 301, 535; 138/33; 52/11, 12, 16; 338/252, 311

[56] References Cited

U.S. PATENT DOCUMENTS

| | | | |
|---|---|---|---|
| 2,687,626 | 8/1954 | Bartlowe | 219/301 |
| 2,716,179 | 8/1955 | Cornella | 219/522 X |
| 3,227,853 | 1/1966 | Gordon | 219/213 |
| 3,331,946 | 7/1967 | Bilbro | 219/301 X |
| 3,582,612 | 6/1971 | Siemianowski | 219/213 |
| 3,617,699 | 11/1971 | Othmer | 219/535 X |

*Primary Examiner*—C. L. Albritton

[57] ABSTRACT

Down spouts have at least one section that is a length of an extruded conduit having lengthwise portions extending from end-to-end thereof with a backing, substantially coextensive in length connected thereto and with a heating element between the backing and the seat defined by the lengthwise portions. Where the down spout includes one or more elbows, shorter sections of the same extrusion are used to form them with those that are disposed angularly having the heating element disposed in an underlying position and with the abutting ends of the sections mitered and sealed together.

5 Claims, 4 Drawing Figures

DOWN SPOUTS PROVIDED WITH HEATING ELEMENTS

RELATED SUBJECT MATTER

This application is a continuation of application Ser. No. 634,043, filed Nov. 21, 1975, now abandoned, which is a continuation of Ser. No. 469,121, filed May 13, 1974, now abandoned, which is a division of Ser. No. 293,297, filed Sept. 28, 1972, now U.S. Pat. No. 3,821,512.

BACKGROUND OF THE INVENTION

Gutters and down spouts present a troublesome problem. Should ice form in a gutter, there is a real threat that water will eventually back up under the shingles and leak into the building as snow accummulates in valleys and along the eaves with interior damage resulting. Even if such damage does not occur, an ice-full gutter will overflow to form icicles. Down spouts, while usually less troublesome, can lead to the gutter problems as they sometimes become ice blocked, usually at their lower ends where they are commonly angled away from the building. With some buildings, there may be freezing at their upper ends in the event the down spout has to be angled inwardly towards the side of the building.

THE PRESENT INVENTION

The objective of the present invention is to provide down spouts that will eliminate icing problems, an objective attained with a water conduit comprising a length of an extrusion having a pair of lengthwise, transversely spaced portions defining an intermediate seat, a backing desirably also an extrusion, substantially coextensive in length with the seat and marginally connected to the lengthwise portions and with a heating element between the seat and the backing, the seat and the backing preferably bonded together after the heating element or elements have been incorporated in the section or sections to provide heat where needed.

Another objective of the invention is to provide a down spout including a vertical section and at least one angularly disposed section formed by lengths of the same extrusion and with the abutting ends of the sections mitered and joined together with the heating elements of the angularly disposed section in an underlying position.

Yet another objective of the invention is to provide that the seat of the extrusion has a plurality of lengthwise channels, each channel dimensioned to receive a length of a heating cable, desirably as a snap fit.

BRIEF DESCRIPTION OF THE DRAWINGS

Preferred embodiments of the invention are shown in the accompanying drawings of which

In FIG. 1 a gutter is shown that consists of a gutter member 10 supported by mounting means including an underlying support 11 and a facia portion 12. A typical building construction has side wall sheathing 13 and a wood facia board 14 nailed to studding 15 and to a double side wall plate 16. In order to provide the advantages of the construction illustrated by U.S. Pat. No. 3,426,488, a tapered, drip edge strip 17 underlying the shingles 18 is fastened to the roof sheathing 19 with its butt edge protruding outwardly beyond the wood facia board 14 and having a depending marginal rib 20 formed with a lengthwise channel 21 that is upwardly and inwardly inclined towards the building to receive the downwardly and outwardly inclined flange 22 extending lengthwise of the upper edge of the facia portion 12 thus to provide a tight joint. The facia portion 12 is shown as secured by an upper and lower series of nails 23.

Figure 1:
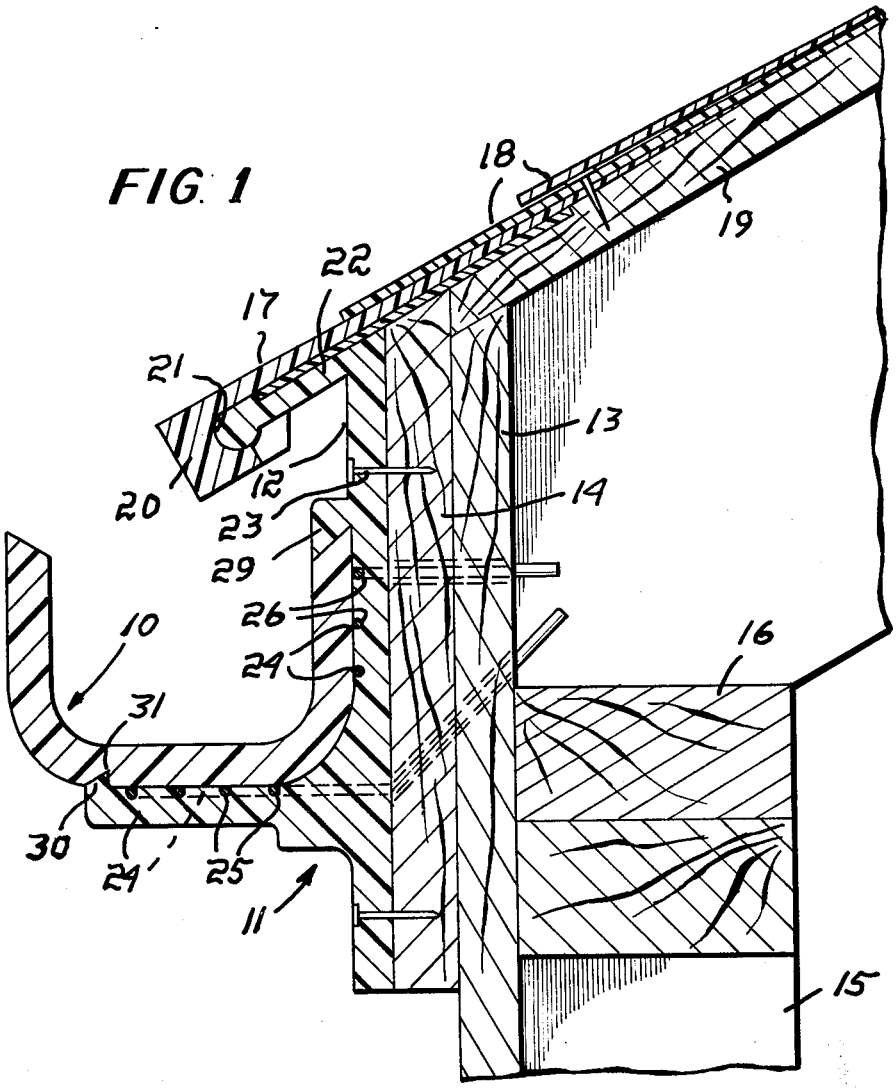
FIG. 1 is a section taken vertically through an installed gutter in accordance with one embodiment of the invention.

The upper surface of the support 11 and the outer surface of the facia portion 12 provide a supporting seat for the gutter member 10 that is shaped and dimensioned to accommodate the major portion of its bottom and its inner wall.

In installing a gutter in accordance with the invention, backing members 11 are first secured to the facia boards 14 of the building. It will be appreciated that while the gutter members 10 and the backing members 11 are both desirably plastic extrusions, for practical reasons they must be cut into a relatively small range of standard lengths. When installed, the ends of one backing member 11 abut the ends of other backing members 11 and, if such abutment occurs at a corner, the abutting ends are mitered. Corners can, of course, be formed from short pieces cut from a standard length if necessary.

When the backing members 11 have been secured in place, a heating cable or cables 24 are installed with their number and disposition being dependent on such factors as the size of the building and heating requirements that are necessary, in that locale, to protect the gutter from freezing. With a small building, a heating cable 24 might extend at least once completely around it but typically, a building is encircled by a series of cables 24, see FIG. 4, and these may all be under the control of a three way relay where it is desired to have the electrical load brought to maximum by stages. Typically, each heating cable 24 is of sufficient length to enable it to be doubled upon itself once or twice to ensure that heat will be applied to the bottom of the gutter member or members 10 along which it extends throughout a sufficiently wide zone to ensure effective heating. The upper surface of each backing portion 11 where it underlies the bottom of a gutter member 10 is provided with parallel channels 25 extending from end-to-end thereof to receive a length of a cable 24, desirably as a snap fit to avoid or minimize the use of cable-anchoring staples.

If additional heating is required, that part of each facia portion 12 that is to be engaged by the inner wall of a gutter member 10 may be recessed to accommodate another heating cable 24, desirably in the form of grooves 26 similar to the grooves 25 and extending from end-to-end of the facia portion.

Figure 4:
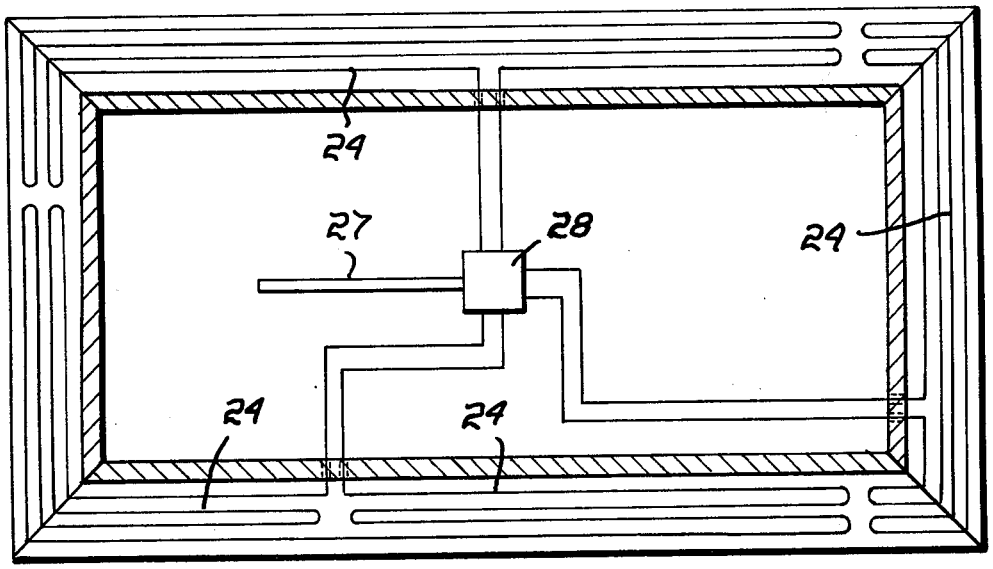
FIG. 4 is a schematic view of the wiring diagram of a typical gutter installation in accordance with the invention.

The thus installed heating cable or cables 24 have their ends extending through the wall structure and into the building, commonly into an attic, where they are connected to a main line 27 by a junction 28, see FIG. 4, together, where the load requires it, with a relay, not shown, providing the appropriate number of stages.

Lengths of gutter members 10 are then secured to the seats which the attached backing members 11 provide and where a gutter member 10 abuts another gutter member, their abutting ends are sealed together by means of a suitable adhesive or by a solvent. Where such abutments occur at a corner, the abutting ends are mitered and, as in the case of the mounting means, corners can be formed from short pieces cut from a gutter member of a standard length.

Each gutter member 10 is secured to the underlying backing member or members 11 as by a suitable adhesive or by the use of a suitable solvent for the mutually engaged surfaces. In order to facilitate the completion of the gutter assembly, each facia portion 12 has an outwardly disposed hook 29 extending from end-to-end thereof and overlying and holding the upper edge of the inner wall of the gutter member or members 10 while the outer edge of each backing member 11 has an upwardly disposed hook 30 extending from end-to-end thereof and disposed and dimensioned to catch in a complementally shaped recess 31 extending lengthwise of the bottom of each gutter member 10 adjacent its outer wall thus to enable each gutter member to be snap-fitted in place and securely held until securely bonded to the backing member with the heating cables 24 between them.

Figure 2:
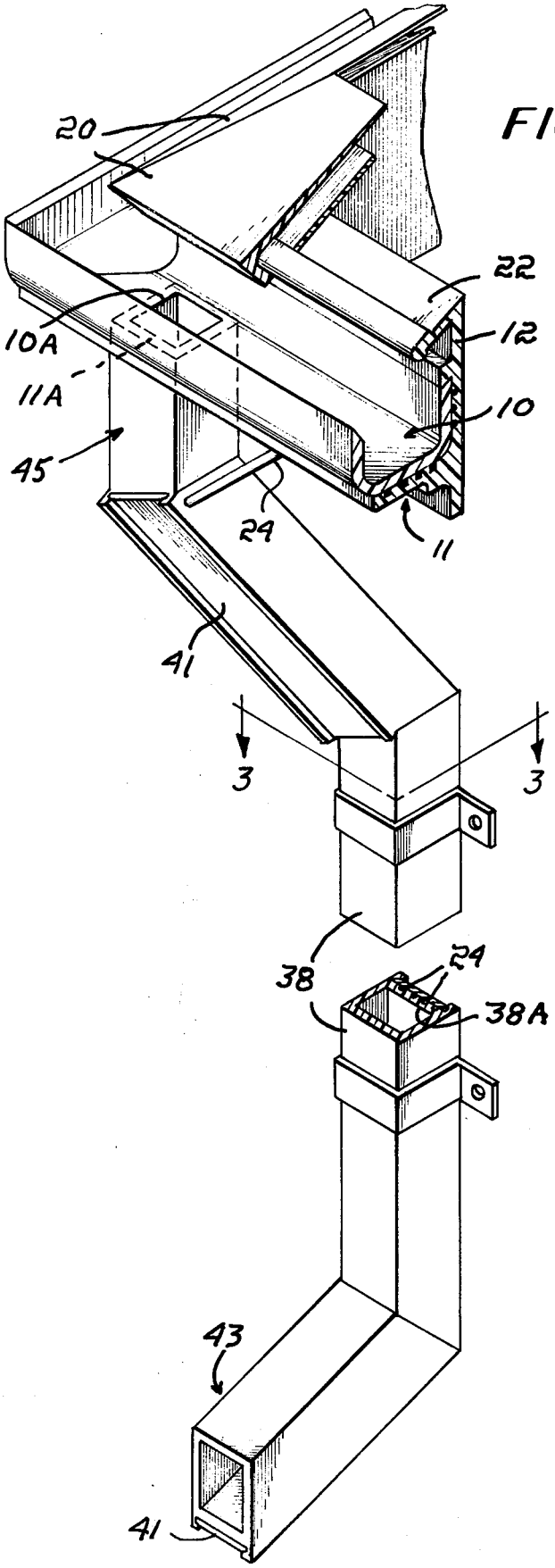
FIG. 2 is a partly sectioned perspective view of an installed down spout in accordance with the invention.
Figure 3:
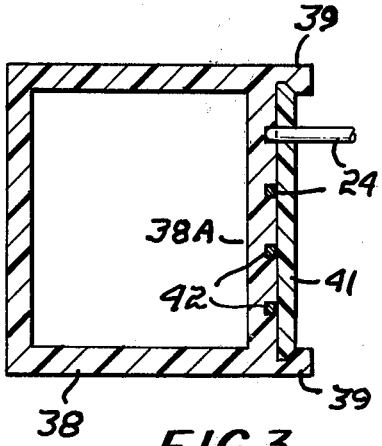
FIG. 3 is a section, on an increase in scale, taken approximately along the indicated line 3—3 of FIG. 2.

Reference is now made to FIGS. 2 and 3 wherein there is shown a down spout in accordance with the invention, the down spout including a vertical section 38 shown as rectangular in cross section and having a wall or seat 38A bordered by ribs 39 having inturned shoulders 40. A backing 41 is dimensioned to be a snap fit in the channel defined by the ribs 39 and substantially of the same length and held therein by the shoulders 40 with heating means disposed between the backing and the seat 38A. The heating means is shown as a heating cable 24 and the seat 38A having lengthwise channels 42 shaped and dimensioned so that a cable 24 is a snap fit therein.

Both the down spout section 38 and the backing 41 are cut into certain standard lengths from extrusions and they may be mitered to enable elbows to be provided where needed, such elbows being formed by shorter lengths of the same extrusions. Desirably both extrusions are of a suitable plastic, polyvinyl chloride, for example. While it is usually unnecessary to heat the vertical section of a down spout, a channel 42 thereof may be used to conceal the heating cable 24 leading to the outwardly and downwardly angled end section 43 of the down spout in which end the wall 38A is in an underlying position. In the case the down spout requires an upwardly and outwardly angled upper end section 44, the down spout portion 44 is cut so that its wall 38A will underlie the bottom thereof although, usually, rising heat is sufficient to prevent icing in that zone. The section 44 has a short vertical section 45 connected thereto. The abutting ends of the several sections are securely interconnected in any desired manner, usually by a suitable adhesive or by the use of an appropriate solvent. The gutter member 10 and its underlying support 11 are provided with ports 10A and 11A, respectively, to enable the upper end of the section 45 to be seated against and similarly sealed to the gutter member 10 desirably under its port 10A.

As in the case of the gutter, it is preferred that, where heat is required as in the end sections 43 and 44, the cable 24 be doubled upon itself once or twice in order that heat be applied through a sufficiently wide zone, requiring that the wall 38A be cross channelled to accommodate the resulting bends. A separate cable 24 may be provided for each end section of the down spout and the cable or cables 24 extend through a side of the down spout section and into the building where it is connected, along with the several other cables to the main line in the manner illustrated by FIG. 4. After a cable or cables 24 have been properly incorporated in a down spout to provide heat where needed, the backing 41 for each section is secured in place by a suitable adhesive or by the use of an appropriate solvent, either before or after the down spout is secured in place.

I claim:

1. A down spout comprising a length of an extruded conduit having a lengthwise passage and a pair of external, integral lengthwise portions transversely spaced to establish an intermediate seat member as a wall of said passage, said portions having lengthwise channels opening towards each other, a backing member substantially coextensive in length with the seat member and dimensioned to fit against said seat with its margins caught by said channels, one of said members having at least one lengthwise groove spaced from said channels, and a heating cable lodged in said groove and held captive between said members, said two members being substantially parallel and substantially in face-to-face contact.

2. The down spout of claim 1 in which the cable receiving groove is in the seat member.

3. The down spout of claim 1 in which the conduit is rectangular in cross section and the backing member is a flat strip.

4. The down spout of claim 3 in which the cable receiving groove is in the seat member.

5. The down spout of claim 1 in which the seat member is of uniform width and thickness throughout its length.

* * * * *